US010239275B2

(12) United States Patent
Kaji et al.

(10) Patent No.: US 10,239,275 B2
(45) Date of Patent: Mar. 26, 2019

(54) CORRUGATED FIBERBOARD PRINTING DEVICE AND BOX-MAKING MACHINE HAVING THE SAME

(71) Applicant: MITSUBISHI HEAVY INDUSTRIES MACHINERY SYSTEMS, LTD., Hyogo (JP)

(72) Inventors: Makoto Kaji, Mihara (JP); Kazuya Sugimoto, Mihara (JP); Makoto Shimohatsubo, Mihara (JP); Kunihiko Yamamuro, Mihara (JP); Takao Hisayuki, Mihara (JP)

(73) Assignee: MITSUBISHI HEAVY INDUSTRIES MACHINERY SYSTEMS, LTD., Kobe-Shi, Hyogo (JP)

( * ) Notice: Subject to any disclaimer, the term of this patent is extended or adjusted under 35 U.S.C. 154(b) by 87 days.

(21) Appl. No.: 15/506,131

(22) PCT Filed: Oct. 27, 2016

(86) PCT No.: PCT/JP2016/081869
§ 371 (c)(1),
(2) Date: Feb. 23, 2017

(87) PCT Pub. No.: WO2017/149836
PCT Pub. Date: Sep. 8, 2017

(65) Prior Publication Data

US 2018/0215119 A1 Aug. 2, 2018

(30) Foreign Application Priority Data

Feb. 29, 2016 (JP) ..... 2016-038068

(51) Int. Cl.
*B31B 50/88* (2017.01)
*B41F 5/24* (2006.01)
(Continued)

(52) U.S. Cl.
CPC ..... *B31B 50/88* (2017.08); *B41F 5/24* (2013.01); *B41J 2/01* (2013.01); *B41J 11/005* (2013.01);
(Continued)

(58) Field of Classification Search
CPC .... B31B 50/88; B65H 5/38; B41J 2/01; B41J 13/10; B41F 5/24
See application file for complete search history.

(56) References Cited

U.S. PATENT DOCUMENTS 2,997,949 A * 8/1961 Ritzerfeld ..... B41L 11/00 101/132.5
4,603,987 A * 8/1986 Kuranishi ..... B41J 13/20 271/171
(Continued)

FOREIGN PATENT DOCUMENTS

EP 1510344 A1 3/2005
JP 2003-72055 A 3/2003
(Continued)

OTHER PUBLICATIONS

PCT/ISA/237 "Written opinion of the International Searching Authority for PCT International Application No. PCT/JP2016/081869" dated Jan. 17, 2017.
(Continued)

*Primary Examiner* — Julian D Huffman
*Assistant Examiner* — Michael T Konczal
(74) *Attorney, Agent, or Firm* — Manabu Kanesaka; Benjamin Hauptman; Kenneth Berner

(57) ABSTRACT

A corrugated fiberboard printing device includes a protection device which regulates approaching of a corrugated fiberboard within a predetermined distance against an inkjet head, and a controller. The protection device includes multiple regulation devices which are juxtaposed in a width
(Continued)

direction of the corrugated fiberboard, and a movement mechanism which moves each of the multiple regulation devices in the width direction. The controller includes a specific column setting unit which is set to classify a specific column, in which a printing quality is less influenced even when the specific column is regulated by the regulation device, with respect to the corrugated fiberboard in a sheet width direction based on order information, and a movement mechanism control unit which controls the operation of the movement mechanism and moves each of the regulation devices so as to regulate the corrugated fiberboard in the specific column.

19 Claims, 6 Drawing Sheets

(51) Int. Cl.

| | |
|---|---|
| ***B41J 2/01*** | (2006.01) |
| ***B65H 5/38*** | (2006.01) |
| ***B41J 13/10*** | (2006.01) |
| ***B41J 11/00*** | (2006.01) |
| ***B41J 13/00*** | (2006.01) |

(52) U.S. Cl.
CPC ..... *B41J 13/0063* (2013.01); *B41J 13/10* (2013.01); *B65H 5/38* (2013.01)

(56) References Cited

U.S. PATENT DOCUMENTS

| | | | | |
|---|---|---|---|---|
| 7,286,257 | B1 | 10/2007 | Morgavi | |
| 9,132,599 | B2 * | 9/2015 | Bober | B31B 1/88 |

FOREIGN PATENT DOCUMENTS

| | | | |
|---|---|---|---|
| JP | 2003-231244 | A | 8/2003 |
| JP | 2003-231340 | A | 8/2003 |
| JP | 2005-169850 | A | 6/2005 |
| JP | 2006-250882 | A | 9/2006 |
| JP | 2009-172842 | A | 8/2009 |

OTHER PUBLICATIONS

Japan Patent Office, "Office Action for Japanese Patent Application No. 2016-038068," dated Nov. 13, 2018.
Europe Patent Office, "Extended European Search Report for European Patent Application No. 16892672.3," dated Jan. 25, 2019.

* cited by examiner

CORRUGATED FIBERBOARD PRINTING DEVICE AND BOX-MAKING MACHINE HAVING THE SAME

RELATED APPLICATIONS

The present application is National Phase of International Application No. PCT/JP2016/081869 filed Oct. 27, 2016, and claims priority from Japanese Application No. 2016-038068, filed Feb. 26, 2016, the disclosure of which is hereby incorporated by reference herein in its entirety.

TECHNICAL FIELD

The present invention relates to a corrugated fiberboard printing device which prints a corrugated fiberboard by an inkjet head and a box-making machine having the same.

BACKGROUND ART

In recent years, various devices which print a corrugated fiberboard using an inkjet type printing device have been developed. In the inkjet type printing device, there is a concern that an inkjet head is damaged if the corrugated fiberboard comes into contact with an inkjet head, and it is necessary to maintain a distance between the inkjet head and the printing surface of the corrugated fiberboard to an appropriate range in order to maintain a constant printing quality. However, since the corrugated fiberboard is not fully flat and is bent or corrugated, in the corrugated fiberboard, a location which slightly floats from a sheet transport passage is generated.

In a case where the inkjet type printing device is applied to the printing of the corrugated fiberboard, it is necessary to prevent the distance between the corrugated fiberboard and the inkjet head from being deviated from an appropriate range (including a contact between the corrugated fiberboard and the inkjet head) due to the floating.

For example, as a technology which maintains the distance between the printing surface of the corrugated fiberboard and the inkjet head to an appropriate range, there is a technology which is disclosed in PTL 1. Hereinafter, the technology which is described in PTL 1 is explained. For reference, reference numerals used in PTL 1 are indicated in parentheses.

A box-making machine (1) of a corrugated fiberboard disclosed in PTL 1 (refer to paragraphs [0021] to [0023 and FIGS. 1 to 6] includes an inkjet type ink head (30) which injects liquid ink to a corrugated fiberboard (S) and a sheet guide device (46) for maintaining a printing quality so as to hold a gap value between the ink head (30) and the corrugated fiberboard (S) to an optimal gap value (t).

The sheet guide device (46) includes a sheet guide (47) which comes into surface contact with the corrugated fiberboard (S) on at least one of the upstream side and the downstream side of the ink head (30) to reduce micro vibrations of the corrugated fiberboard (S). Preferably, the sheet guide (47) is not only displaced on the corrugated fiberboard (S) simply so as to stabilize the corrugated fiberboard (S) when the printing is performed, but the sheet guide (47) is also slightly pressed to the corrugated fiberboard (S) so as to not substantially collapse the corrugated fiberboard (S).

CITATION LIST

Patent Literature

[PTL 1] Japanese Unexamined Patent Application Publication No. 2003-231244

SUMMARY OF INVENTION

Technical Problem

However, in the technology which is disclosed in PTL 1, since the sheet guide (47) comes into surface contact with the corrugated fiberboard (S), ink is transferred to the sheet guide (47) according to the position of the sheet guide (47), there is a concern that a printed pattern may be polluted, and the corrugated fiberboard is likely to be damaged by the pressurized sheet guide (47).

In addition, PTL 1 describes that the sheet guide (47) moves in a width direction of the machine according to a printing location. However, PTL 1 does not describe how the sheet guide (47) specifically moves according to the printing location, and in PTL 1, a problem that the sheet guide (47) may pollute the printed pattern is not recognized.

An object of the present invention is to provide a corrugated fiberboard printing device and a box-making machine in which it is possible to prevent the corrugated fiberboard from coming into contact with the inkjet head before the contact occurs while preventing a decrease in a printing quality of the corrugated fiberboard.

Solution to Problem (1) In order to achieve the object, according to the present invention, there is provided a corrugated fiberboard printing device which prints a pattern to a corrugated fiberboard which is transported on a transport passage, including: an inkjet head which is disposed above the transport passage and injects ink to the corrugated fiberboard; a protection device which regulates approaching of the corrugated fiberboard within a predetermined distance against the inkjet head; and a controller which acquires order information of the corrugated fiberboard from a production management device and controls the operations of the inkjet head and the protection device, in which the protection device includes multiple regulation means which are juxtaposed in a width direction of the corrugated fiberboard, and a movement mechanism which moves each of the multiple regulation means in the width direction, and the controller includes a specific column setting unit which is set to classify a specific column, in which a printing quality is less influenced even when the specific column is regulated by the regulation means, with respect to the corrugated fiberboard in a sheet width direction based on the order information, and a movement mechanism control unit which controls the operation of the movement mechanism and moves each of the regulation means so as to regulate the corrugated fiberboard in the specific column.

(2) Preferably, the specific column setting unit sets a low ink coverage column, in which ink coverage is a threshold value or less, to the specific column.

(3) Preferably, as a column has lower ink coverage, the specific column setting unit preferentially sets the column to the specific column.

(4) Preferably, the specific column setting unit sets a creasing location at which creasing is formed or a glue application location at which glue is applied to the specific column in a case where the low ink coverage column does not exist or a distribution of the low ink coverage columns is biased.

(5) Preferably, the specific column setting unit sets a creasing location at which creasing is formed to the specific column.

(6) Preferably, the specific column setting unit sets a glue application location at which glue is applied to the specific column.

(7) Preferably, each of the regulation means is a regulation part which is disposed above the transport passage by at least the thickness of the corrugated fiberboard and comes into contact with the corrugated fiberboard to regulate an upward displacement of the corrugated fiberboard.

(8) Preferably, the regulation part is disposed so as to be separated from the upper surface of the corrugated fiberboard.

(9) Preferably, the movement mechanism further includes a mechanism which moves the regulation part forward and rearward against the transport passage, the controller includes a sheet thickness acquisition unit which acquires thickness information of the corrugated fiberboard, and the movement mechanism control unit lifts and lowers the regulation part based on the thickness information which is acquired by the sheet thickness acquisition unit.

(10) Preferably, the specific column setting unit set the specific column using total ink coverage of printing on the upstream side of the regulation part in a transport direction of the corrugated fiberboard as the ink coverage.

(11) Preferably, the regulation part is provided on the upstream side of the inkjet head in the transport direction and the corrugated fiberboard is printed by one or more other printing units on the upstream side of the regulation part in the transport direction, the specific column setting unit obtains the total ink coverage by summing ink coverage of printing by the one or more other printing units, and when the specific column setting unit obtains the total ink coverage, the specific column setting unit corrects each ink coverage of the printing by the one or more other printing units according to a degree of dryness of each ink on the corrugated fiberboard by the printing of the one or more other printing units.

(12) Preferably, the regulation part is provided on the downstream side of the inkjet head in the transport direction and the corrugated fiberboard is printed by one or more other printing units on the upstream side of the regulation part in the transport direction, the specific column setting unit obtains the total ink coverage by summing ink coverage of printing by the one or more other printing units and ink coverage of printing by the inkjet head, and when the specific column setting unit obtains the total ink coverage, the specific column setting unit corrects each ink coverage of the printing by the one or more other printing units according to a degree of dryness of ink on the corrugated fiberboard by the printing of the one or more other printing units, and corrects the ink coverage of the printing by the inkjet head according to a degree of dryness of ink on the corrugated fiberboard by the printing of the inkjet head.

(13) Preferably, the corrugated fiberboard is printed by one or more other printing units on the upstream side of the regulation part in the transport direction, the one or more other printing units have a print cylinder which rotates at the same peripheral speed as a transport speed of the corrugated fiberboard, and the regulation part is a roller which is rotated to be driven by the movement of the transported corrugated fiberboard and has the same diameter as the diameter of the print cylinder.

(14) Preferably, the inkjet head is provided to face a transport surface of the corrugated fiberboard in a box-making machine, each of the regulation means is configured of an injection device which injects air to the corrugated fiberboard from above, and the specific column setting unit sets the specific column using ink coverage of printing by the inkjet head as the ink coverage.

(15) In order to achieve the object, according to the present invention, there is provided a box-making machine of a corrugated fiberboard includes the corrugated fiberboard printing device according to any one of (1) to (14) which is provided on the downstream side of the printing unit in a transport direction of the corrugated fiberboard.

Advantageous Effects of Invention

According to the present invention, the specific column, in which a printing quality of the corrugated fiberboard is less influenced, is set based on the order information of the corrugated fiberboard, and approaching of the corrugated fiberboard within the predetermined distance against the inkjet head is regulated in the specific column.

Accordingly, it is possible to prevent the corrugated fiberboard from coming into contact with the inkjet head before the contact occurs while preventing a decrease in a printing quality of the corrugated fiberboard.

BRIEF DESCRIPTION OF DRAWINGS

FIG. 2A is a perspective view when viewed from rearward and right obliquely upward, and FIG. 2B is a perspective view when viewed from forward and obliquely upward.

FIG. 3A is a perspective view when an A1 portion of FIG. 2A is viewed from rearward and left obliquely, and FIG. 3B is a view when an A2 portion of FIG. 2A is viewed from the front in a state where a rear frame is removed.

DESCRIPTION OF EMBODIMENTS

Hereinafter, embodiments of the present invention will be described with reference to the drawings. In addition, each embodiment described below is only an example, and the present invention includes various modifications and technologies which are not described in the following embodiments. Each of configurations of the following embodiments can be exemplified so as to be variously modified within the scope which does not depart from the gist, and the configurations can be appropriately selected or appropriately combined.

In the following descriptions, a direction in which a corrugated fiberboard is transported in a box-making machine is referred to as a transport direction F or a sheet transport direction F, a direction orthogonal to the transport direction F is referred to as a width direction W, a sheet width direction W, or a horizontal direction W. In addition, a side toward a center CL in the width direction of the corrugated fiberboard is referred to an inner side, and conversely, a side which is away from the center CL in the width direction is referred to an outer side.

In a case where it is not specifically described, an upstream means the upstream in the transport direction, and similarly, in a case where it is not specifically described, a downstream means the downstream in the transport direction F.

In a case where it is not specifically described, a front side or a front surface means the downstream side in the transport direction F, and similarly, in a case where it is not specifically described, a rear side or a rear surface means the upstream side in the transport direction F.

[1. First Embodiment]

[1-1. Configuration of Box-Making Machine]

First, the configuration of the box-making machine according to the present embodiment will be described.

Figure 1:
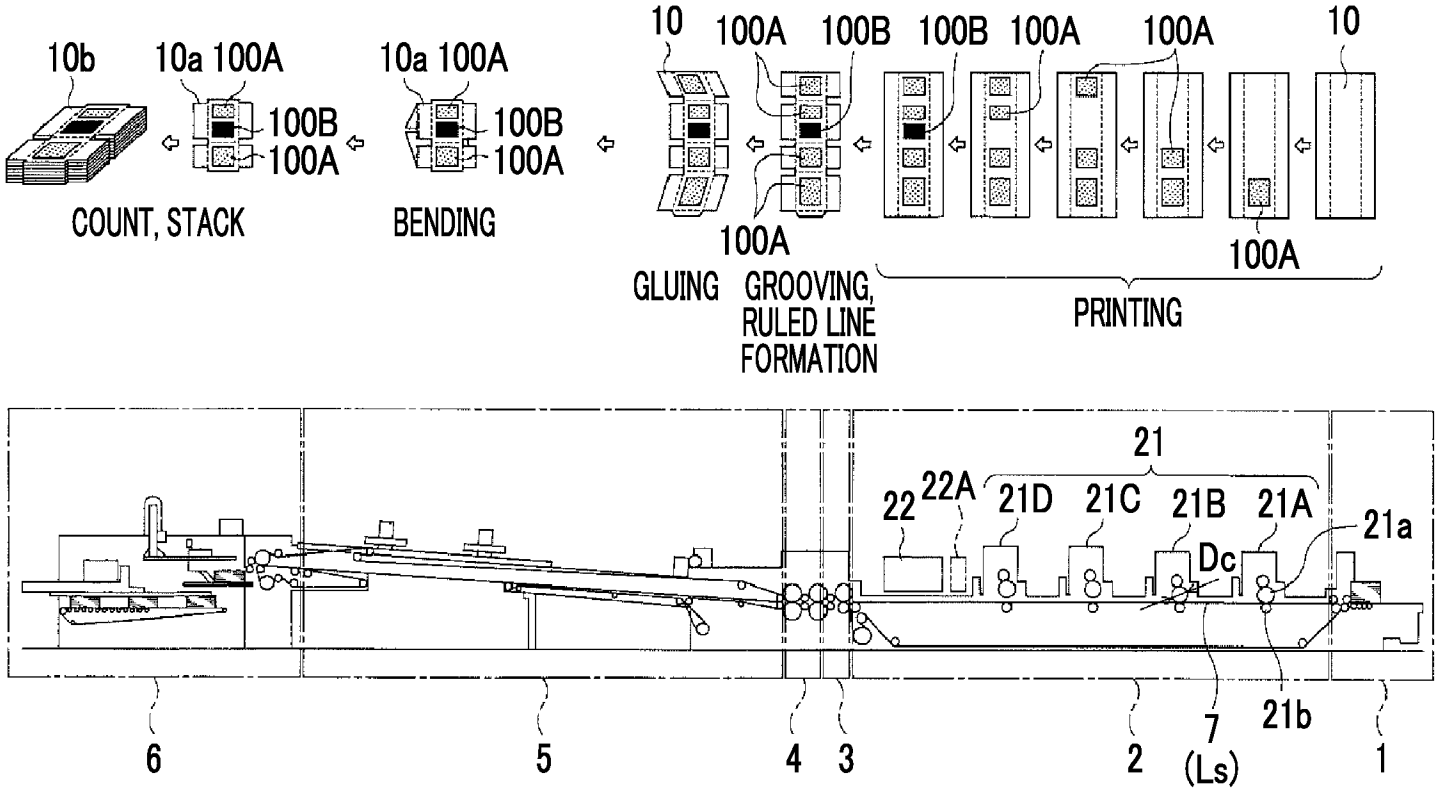
FIG. 1 is a schematic side view showing a configuration of a box-making machine of a corrugated fiberboard according to a first embodiment of the present invention.

In FIG. 1, a process in which a corrugated fiberboard is processed to a sheet-like corrugated box is divided according to device configurations so as to be associated with the device configurations above the device configurations of each process of the box-making machine. As shown in FIG. 1, in the box-making machine, a paper feed section 1, a printing section 2, a paper discharge section 3, a die-cut section 4, a folder-gluer section 5, and a counter-ejector section 6 are provided in this order from the upstream side.

In the paper feed section 1, multiple plate-shaped corrugated fiberboards 10 are carried in a state where the corrugated fiberboards 10 are stacked, and the corrugated fiberboards 10 are supplied (fed) to the printing section 2 one by one.

In the printing section 2, a pattern is printed to the corrugated fiberboard 10 which is transported by a transport conveyor 7 one by one. In the printing section 2, flexographic printing unit (other printing units) 21A to 21D having a predetermined number of colors (here, four colors) are provided above a transport passage (hereinafter, referred to as a sheet transport passage) Ls of the corrugated fiberboard 10, and an inkjet printing unit 22 is provide above the sheet transport passage Ls on the downstream sides of the flexographic printing units 21A to 21D (hereinafter, the flexographic printing units 21A to 21D are collectively referred to as a flexographic printing section 21).

The flexographic printing units 21A to 21D sequentially perform printing on the corrugated fiberboard by ink of each color, and each of the flexographic printing units 21A to 21D includes a plate cylinder (print cylinder) 21*a* on which a printing table to which flexographic ink is transferred mounted and a receiving roll 21*b* which causes the corrugated fiberboard 10 to come into pressure-contact with the plate cylinder 21*a*, and prints a print image formed on the printing plate, that is, a fixed pattern (hereinafter, referred to as a fixed pattern) 100A on the corrugated fiberboard 10.

Diameters Dc of the plate cylinders 21*a* of the flexographic printing units 21A to 21D are set to be the same as each other, and each of the flexographic printing units 21A to 21D rotates at the same peripheral speed as a transport speed of the corrugated fiberboard 10 during printing.

The inkjet printing unit 22 prints a pattern (hereinafter, referred to as a variable pattern) 100B which is changed for each sheet or every a plurality of sheets on the corrugated fiberboard 10 based on a digital source. The inkjet printing unit 22 configures the corrugated fiberboard printing device of the present invention along with a controller 20 described below which controls the inkjet printing unit 22.

In the paper discharge section 3, grooving or a creasing formation is performed on the corrugated fiberboard 10 printed by the printing section 2, and the corrugated fiberboard 10 is discharged.

In the die-cut section 4, drilling is performed on the corrugated fiberboard 10 discharged from the paper discharge section 3 or grooving or a creasing formation is further performed on the corrugated fiberboard 10.

In the folder-gluer section 5, glue is applied to one end in a horizontal direction W of the corrugated fiberboard 10 processed by the die-cut section 4, and bending is performed such that both right and left end portion of the corrugated fiberboard 10 overlap each other on the rear side (lower side). Both right and left end portions of the corrugated fiberboard 10 processed in the folder-gluer section 5 are bonded to each other by glue, and a sheet-like corrugated box (box sheet material) 10*a* is formed.

In the counter-ejector section 6, the box sheet materials 10*a* processed in the folder-gluer section 5 are placed on a table (stacker table) while being countered. If a predetermined number of box sheet materials 10*a* are stacked in the counter-ejector section 6, a sheet material group 10*b* is shipped as a batch of one unit.

[1-2. Configuration of Inkjet Printing Unit]

The inkjet printing unit 22 will be described with reference to FIGS. 2A, 2B, 3A, and 3B.

Figures 2A, 2B:
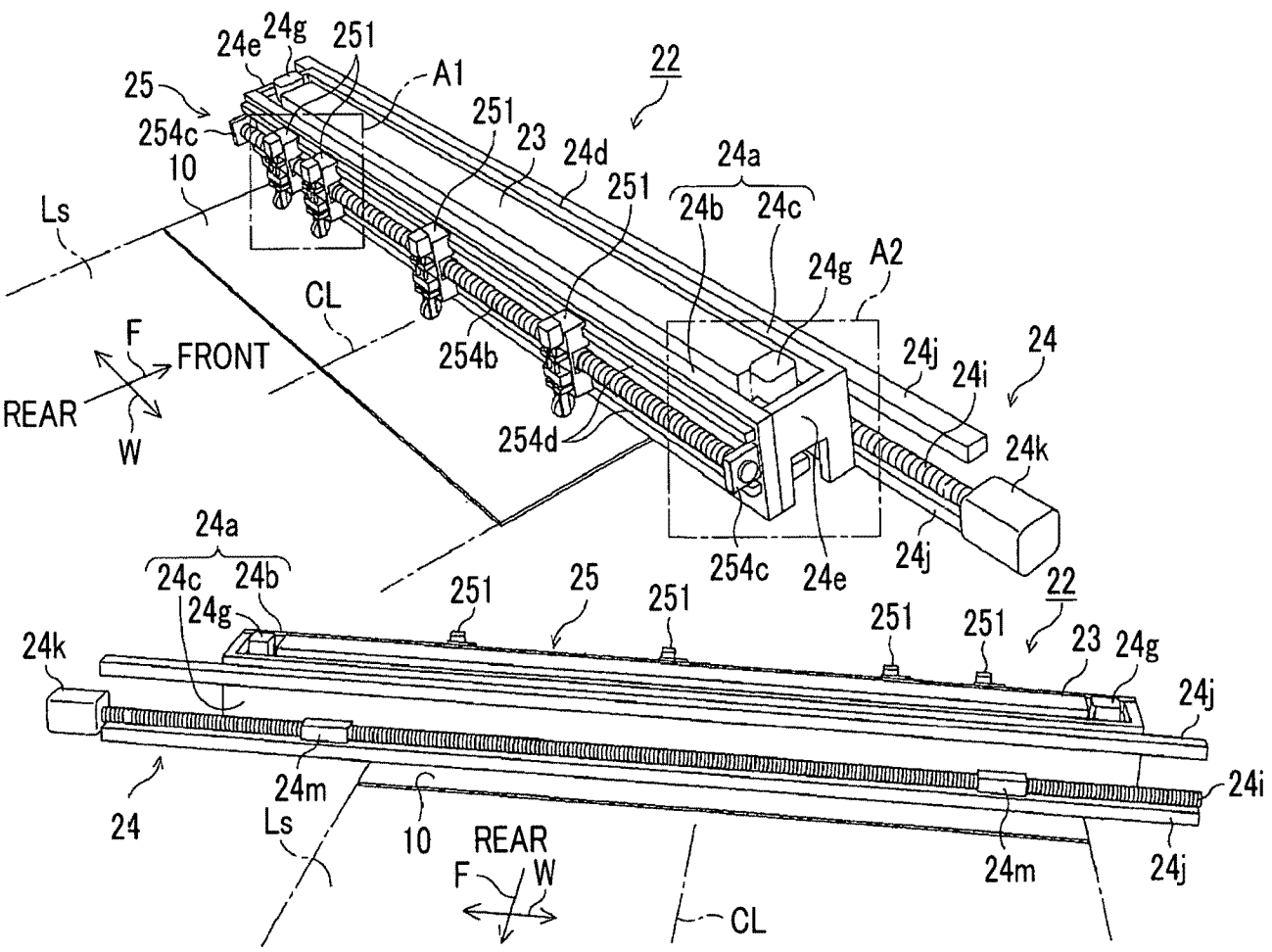
FIGS. 2A and 2B are schematic views showing the overall configuration of an inkjet printing unit according to the first embodiment of the present invention.

FIGS. 2A and 2B are schematic views showing the overall configuration of the inkjet printing unit according to the first embodiment of the present invention, FIG. 2A is a perspective view when viewed from rearward (inlet side of the corrugated fiberboard 10) and right obliquely upward, and FIG. 2B is a perspective view when viewed from forward (outlet side of the corrugated fiberboard 10) and obliquely upward.

Figure 3A:
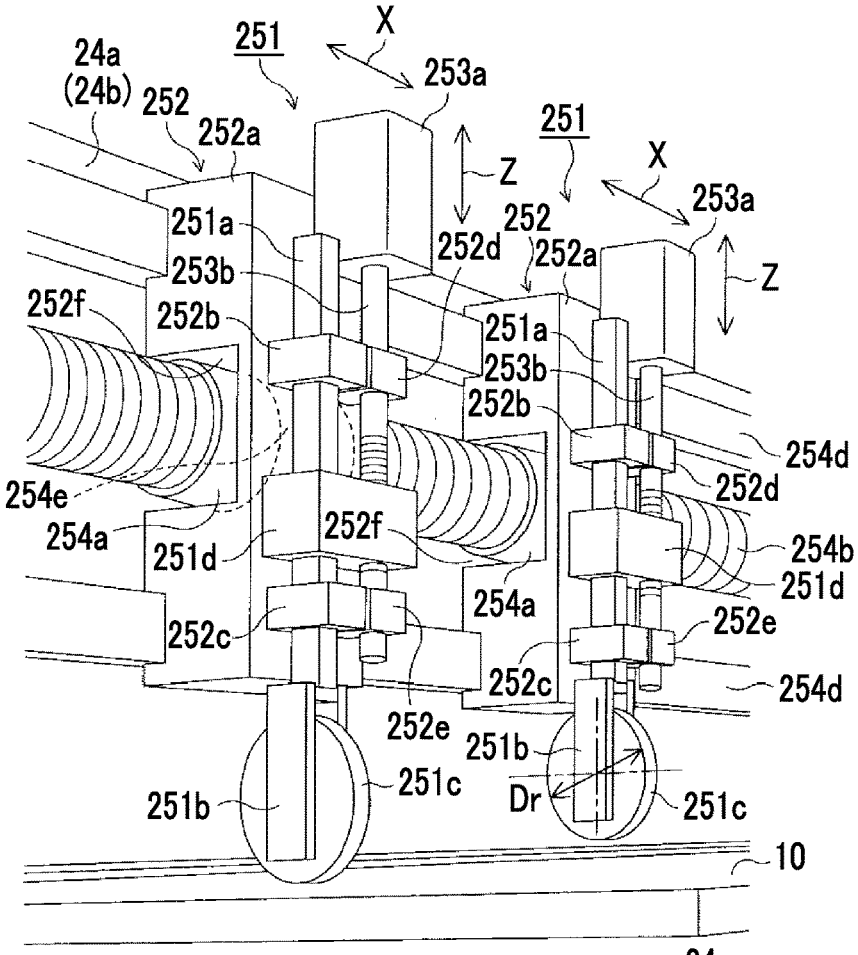
FIGS. 3A and 3B are schematic views showing a partial configuration of the inkjet printing unit of the first embodiment of the present invention.
Figure 3B:
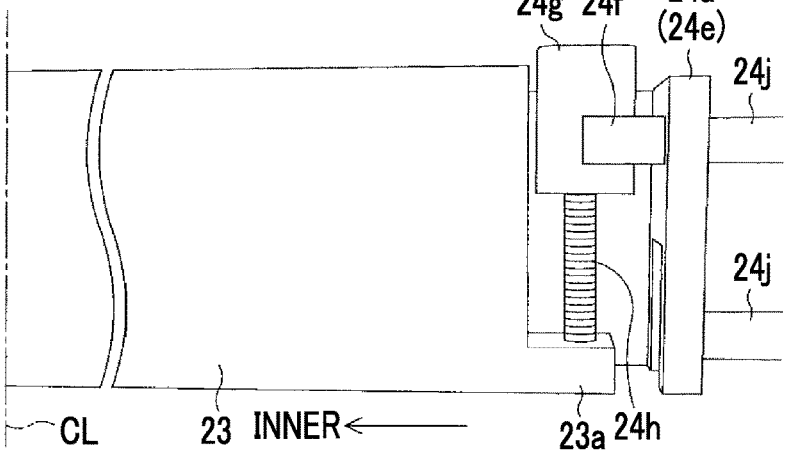

FIGS. 3A and 3B are schematic views showing a partial configuration of the inkjet printing unit of the first embodiment of the present invention, FIG. 3A is a perspective view when an A1 portion of FIG. 2A is viewed from rearward and left obliquely, and FIG. 3B is a view when an A1 portion of FIG. 2A is viewed from the front in a state where a rear frame is removed.

As shown in FIGS. 2A and 2B, the inkjet printing unit 22 includes an inkjet head (hereinafter, referred to as a head) 23, a head movement unit 24 which moves the head 23, and a pressing unit (protection device) 25 which regulates floating of the corrugated fiberboard 10.

The head 23 includes multiple inkjet injection ports on a lower surface which faces the corrugated fiberboard 10, and can print a predetermined printing pattern on the corrugated fiberboard 10 by injecting ink from inkjet injection ports positioned at a position corresponding to a printing pattern (variable pattern).

The head movement unit 24 can move the head 23 up/down and right/left (width direction). The head movement unit 24 includes a frame body 24*a* having open upper portion and lower portion, and the head 23 and the pressing unit 25 are fixed to the frame body 24*a*.

The frame body 24*a* is configured of two parts such as a rear frame 24*b* and a front frame 24*c*. The front frame 24*c* is an U shaped frame in a plan view having an open rear side, and in the front frame 24*c*, a flat plate-shaped front wall portion 24*d* which extends in the width direction W and side wall portions 24*e* and 24*e* which extend from both edges of the front wall portion 24*d* in the width direction to the rear side are integrally configured. The rear frame 24*b* is a flat plate-shaped frame which extends in the width direction W and is assembled to the rear end surface of both side wall portions 24*e* of the front frame 24*c* so as to close the open rear side of the front frame 24*c*. In addition, the frame body 24*a* may be configured of four parts such as the rear frame 24*b*, the front wall portion 24*d*, the side wall portion 24*e*, and the side wall portion 24*e*.

As shown in FIG. 2B, nut portions 24*m* which are positioned so as to close to the end portions of the front frame 24*c* in the width direction protrude from the front surface of the front frame 24*c*, and one screw shaft 24*i* which extends in the width direction W is inserted into the nut portions 24*m*. A pair of rails 24*j* which extends in parallel to the screw shaft 24*i* is provided above and below the screw shaft 24*i*. The rails 24*j* are laid between a pair of device frames (not shown) and are in contact with the front surface of the front frame 24*c*.

The screw shaft 24*i* is connected to a motor 24*k* which is fixed to the device frame (not shown), and it is possible to move the head 23 in the width direction W while guiding the head 23 by the rails 24*j* integrally with the frame body 24*a* by rotationally driving the screw shaft 24*i* using the motor 24*k*.

As shown in FIG. 3B, brackets 24*f* protrude from inner wall surfaces of both side wall portions 24*e* of the frame body 24*a*, and a motor 24*g* is fixed to the tip of each of the brackets 24*f*. The motor 24*g* is connected to the upper portion of a screw shaft 24*h* which vertically extends and rotationally drives the screw shaft 24*h*. The inkjet head 23 is disposed inside the frame body 24*a*, and each screw shaft 24*h* is screwed to each nut portion 23*a* which protrudes from each of both side surfaces of the inkjet head 23. It is possible to vertically move the head 23 via the nut portion 23*a* by rotationally driving the screw shaft 24*h* using the motor 24*g*.

In addition, the head 23 is fixed to the frame body 24*a* via the nut portion 23*a*, the screw shaft 24*h*, the motor 24*g*, and the bracket 24*f*.

The pressing unit 25 will be described. As a gap between the ink injection port of the head 23 and a printing surface (the upper surface of the corrugated fiberboard 10, and hereinafter, referred to as a sheet printing surface) of the corrugated fiberboard 10 increases, accuracy of a position (printing position) at which ink is landed on a sheet printing surface decreases. Accordingly, a gap dimension between the lower surface of the head 23 on which the ink injection port is formed and the sheet printing surface is set to a slight dimension (for example, 1 mm or more and 5 mm or less).

As described in the Background Art, the corrugated fiberboard 10 is not fully flat and is bent or corrugated. Accordingly, in the corrugated fiberboard 10, a location which slightly floats from the transport passage Ls is generated. Since the gap dimension between the head 23 and the corrugated fiberboard 10 is a slight dimension, if the floating of the corrugated fiberboard 10 increases, there is a concern that the corrugated fiberboard 10 comes into contact with the head 23 and the ink injection port of the head 23 or the head main body is damaged. Accordingly, the pressing unit 25 is provided so as to regulate approaching of the corrugated fiberboard 10 within a predetermined distance against the head 23 due to the floating of the corrugated fiberboard 10, and contact between the corrugated fiberboard 10 and the ink injection port is prevented.

As shown in FIGS. 2A and 2B, the pressing unit 25 is provided on the rear side (upstream side) of the head 23 in the sheet transport direction F in the present embodiment and is installed on the rear surface of the frame body 24*a* of the head movement unit 24. In addition, the pressing unit 25 includes multiple pressing roller units (regulation means, regulation part) 251 which are arranged in the width direction W and a mechanism which moves each of the pressing roller units 251 vertically and horizontally.

As shown in FIG. 3A, each pressing roller unit (hereinafter, referred to as a roller unit) 251 includes a rod 251*a* which vertically extends, a rotation support member 251*b* which defines the lower surface of the rod 251*a*, and a pressing roller 251*c* which is rotationally supported by the rotation support member 251*b*. The rotation support member 251*b* is an approximately U-shaped member having an open lower portion, and the pressing roller 251*c* is rotationally supported inside the U-shaped portion. A bracket 251*d* (hereinafter, referred to as a rod bracket) which is long in the width direction is fixed to the rod 251*a*. The rod bracket 251*d* is a wide bracket having a width dimension which is larger than the width dimension of the rod 251*a* and is approximately the same width dimension as that of a movement block 252 described below, and protrudes toward one side (toward the right side in FIG. 3A) in the width direction from the rod 251*a*.

In a present embodiment, a diameter Dr of the pressing roller 251*c* is set to be smaller than a diameter Dc (refer to FIG. 1) of the plate cylinder 21*a* of each of the flexographic printing units 21A to 21D. In addition, preferably, the pressing roller 251*c* uses a roller which prevents the roller from being rubbed to the pattern (ink) of the corrugated fiberboard 10 to pollute the corrugated fiberboard 10 and prevents the corrugated fiberboard 10 from being damaged when the roller comes into contact with the corrugated fiberboard 10. Specifically, preferably, the pressing roller 251*c* is a lightweight roller which is easily rotated according to the movement of the transported corrugated fiberboard 10 when the roller comes into contact with the corrugated fiberboard 10. In addition, preferably, the pressing roller 251*c* is a roller having the surface which is formed of a soft material, or a so-called potato roller which has an uneven surface and a small contact area even when the roller comes into contact with the corrugated fiberboard 10. In addition, instead of the pressing roller 251*c*, a sheet guide which has a brush or a guide surface on a low-friction coating is provided may be installed so as to face the transport passage Ls.

Each of the roller units 251 can move in the width direction W as shown in an arrow X, and can be lifted and lowered (can move forward and rearward against the corrugated fiberboard 10) as shown in an arrow Z. A specific configuration which moves each roller unit 251 in this way will be described.

Each roller unit 251 is attached to the movement block 252 which can vertically move. The movement block 252 includes a block main body 252*a* having an approximately rectangular parallelepiped shape which is vertically elongated and brackets 252*b* to 252*e* which are fixed to the rear surface of the block main body 252*a*. Each of the brackets 252*b* to 252*e* is a narrow bracket which is approximately half of the width dimension of the block main body 252*a*.

The brackets 252*b* and 252*c* are close to the other side (the left side in FIG. 3A) in the width direction of the block main body 252*a*, and are juxtaposed above and below the rod bracket 251*d*. Hole portions which vertically penetrate are provided in the brackets 252*b* and 252*c*, and the rod 251*a* is inserted into the hole portions so as to be vertically moved.

The brackets 252*d* and 252*e* are close to one side (the right side in FIG. 3A) in the width direction of the block main body 252*a*, and are juxtaposed above and below the rod bracket 251*d*. Hole portions which vertically penetrate are provided in the brackets 252*d* and 252*e*, and a screw shaft 253*b* which vertically extends and on which screws are partially formed is rotatably inserted into the hole portions.

In addition, the upper side of the screw shaft 253*b* is connected to the motor 253*a* connected to the block main body 252*a* and the lower side of the screw shaft 253*b* is screwed to one side (the right side in FIG. 3A) of the rod bracket 251*d* in the width direction. According to this configuration, if the screw shaft 253*b* is rotated by the motor 253*a*, and the roller unit 251 is lifted and lowered on the screw shaft 252*b* via the rod bracket 251*d*. That is, in the movement mechanism which moves the regulation means of the present invention, the function which lifts and lowers the regulation means is configured of the motor 253*a*, the screw shaft 253*b*, and the rod bracket 251*d*.

In addition, screws are partially formed on the screw shaft 253*b* such that the roller unit 251 can be lifted and lowered by a necessary range. Since screws are not formed on the locations of the screw shaft 253*b* which are inserted into the brackets 252*d* and 252*e*, even when the screw shaft 253*b* rotates, a force which lifts and lowers the brackets 252*d* and 252*e* does not act on the brackets 252*d* and 252*e* from the screw shaft 253*b*. That is, the brackets 252*d* and 252*e* are guide brackets.

A recessed portion 252*f* is formed on the front surface of the block main body 252*a* of each movement block 252. A hollow motor 254*e* and a nut 254*a* which is vertically rotated and driven by the hollow motor 254*e* are accommodated in the recessed portion 252*f*. A common screw shaft 254*b* which extends in the width direction W is inserted into and screwed to respective nuts 254*a*. In addition, in FIG. 3A, the hollow motor 254*e* is shown so as to be simplified.

The screw shaft 254*b* is behind the rear frame 24*b* of the frame body 24*a*. A pair of brackets 254*c* is attached to both edges of the rear surface of the rear frame 24*b* in the width direction. Both ends of the screw shaft 254*b* are fixed to the brackets 254*c*.

In addition, a pair of rails 254*d* which extends to be parallel to the screw shaft 254*b* is provided on the rear surface of the rear frame 24*b* above and below the screw shaft 254*b*. Each of the rails 254*d* is provided over the entire width of the front frame 24*b*. The rails 254*d* are slidingly fitted to the front surface of the block main body 252*a* above and below the recessed portion 252*f*.

According to this configuration, if the nut 254*a* is rotationally driven by the hollow motor 254*e* of the movement block 252, the roller unit 251 is moved on the screw shaft 254*b* in the width direction W while being guided on the rails 254*d* integrally with the movement block 252. That is, in the movement mechanism which moves the regulation means of the present invention, the function which moves the regulation means in the width direction is configured of the hollow motor 254*e*, the nut 254*a*, the screw shaft 254*b*, and the rails 254*d*.

In addition, the movement block 252 of the roller unit 251 is attached to the frame body 24*a* of the head movement unit 24 via the nut 254*a*, the screw shaft 254*b*, and the bracket 254*c*. Accordingly, it is possible to move the roller unit 251 integrally with the inkjet head 23 in the width direction W by the head movement unit 24.

[1-3. Configuration of Controller]

The configuration of the controller 20 which controls the operation of the inkjet printing unit 22 will be described with reference to FIG. 4.

Figure 4:
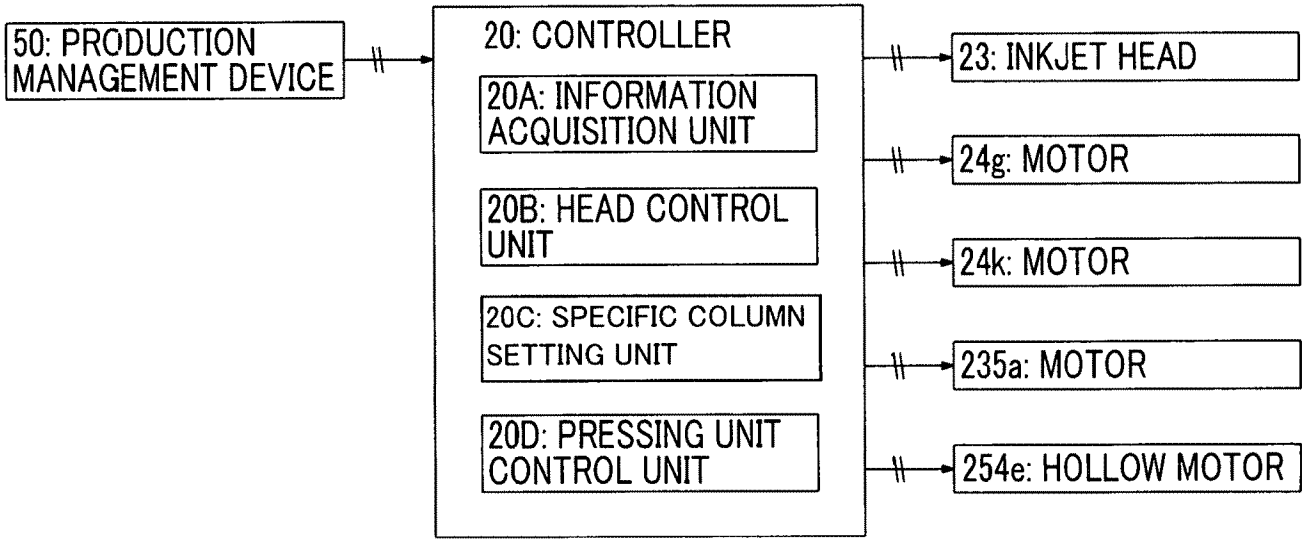
FIG. 4 is a block diagram showing a configuration of a controller of the inkjet printing unit according to the first embodiment of the present invention.

FIG. 4 is a block diagram showing the configuration of the controller of the inkjet printing unit according to the first embodiment of the present invention.

The controller 20 acquires various order information such as pattern information (ink coverage, pattern, disposition of pattern, or the like) or thickness information (hereinafter, referred to as sheet thickness information) of the corrugated fiberboard 10 from a production management device 50, and controls the operation of the inkjet printing unit 22 based on various order information. As shown in FIG. 4, the controller 20 is configured to include an information acquisition unit (sheet thickness acquisition unit) 20A, an inkjet head control unit (hereinafter, referred to as a head control unit) 20B, a specific column setting unit 20C, and a pressing unit control unit (movement mechanism control unit) 20D.

The information acquisition unit 20A acquires various order information from the production management device 50.

The head control unit 20B controls the operation of the motor 24*g* based on the sheet thickness information acquired from the production management device 50, and moves the head 23 such that the head 23 reaches an appropriate height which is higher than the printing surface of the corrugated fiberboard 10 by a predetermined distance (for example, 1 mm or more and 5 mm or less).

In addition, if an operation switch (not shown) is operated, or automatically, the head control unit 20B controls the operation of the motor 24*g* when the inkjet printing unit 22 is stopped or at the time of maintenance of the inkjet printing unit 22 to integrally move the head 23 and the pressing unit 24 so as to be close to one end (move the head and the pressing unit 24 to standby positions).

In addition, the head control unit 20B output a control command to the head 23 based on the pattern information (printing by the inkjet printing unit 22, or disposition of the patterns) acquired from the production management device 50, and prints a predetermined variable pattern on the corrugated fiberboard by injecting ink from the ink injection port positioned at the position corresponding to the pattern to the corrugated fiberboard 10.

The specific column setting unit 20C acquires a distribution of ink coverage in the sheet width direction W, a creasing location, or a glue application location from the production management device 50 as the order information, and selects the specific column based on the information. Here, the specific column is a column which is classified in the sheet width direction W, and is a column in which a printing quality of the corrugated fiberboard 10 is less influenced by the contact between the pressing roller 251*c* and the corrugated fiberboard 10 even when the pressing roller 251*c* of the roller unit 251 comes into contact with the corrugated fiberboard 10. As a typical specific column, there is a margin portion in which the printing pattern does not exist.

In addition, the "ink coverage" means an ink attachment area ratio of the sheet surface on the line in the printing direction. For example, in a case where the entire ink is not attached to a predetermine width column on the printing surface of one corrugated fiberboard 10 in the line in the printing direction, the ink coverage of the width column becomes 0%, and in a case where the entire ink is attached to a width column, the ink coverage of the width column becomes 100%.

Specifically, the specific column setting unit 20C sets the number (four locations in the present embodiment) which coincides with the number of roller unit 251 to an upper limit, and sequentially sets the specific column according to the priority level. In the specific column, a low ink coverage column (a column in which the ink coverage is 0%, that is, includes a column in which the pattern by the flexographic printing does not exist) is firstly preferentially set (priority level 1), in which the ink coverage (that is, total ink coverage of the flexographic printing units 21A to 21D) Ra_F of the flexographic printing section 21 which performs printing on the upstream of the pressing unit 25 of the inkjet printing unit 22 is a predetermined threshold Ra_Th or less, the glue application location is secondarily preferentially set (priority level 2), and the creasing location is thirdly preferentially set (priority level 3).

In addition, the threshold Ra_Th is appropriately set to be 0% or more, and only the column in which the threshold Ra_Th is set to 0% and the pattern does not exist may be set to the low ink coverage column by the specific column setting unit 20C. In addition, the creasing location may be preferentially set to the specific column than the glue application location.

In a case where the low ink coverage column is set to the specific column, it is assumed that the specific column is a column having a wider width than the width of the pressing roller 251*c*. This is because if the width of the specific column is narrower than the width of the pressing roller 251*c*, the pressing roller 251*c* comes into contact with the corrugated fiberboard 10 at a column deviated from the specific column, and the pressing roller 251*c* is likely to come into contact with a column having a high ink coverage outside the specific column.

In a case where there are multiple low ink coverage columns, a location having lower ink coverage is preferentially set to the specific column.

In addition, since the corrugated fiberboard 10 include multiple locations having the same priority level as each other, in a case where the specific columns cannot be narrowed to match the number (four locations in the present embodiment) of the roller units 251 by only the priority level (for example, in a case where the number of the margin portions is five or more), the specific column setting unit 20C selects the specific columns such that the corrugated fiberboard 10 can equally dispose the specific column in the width direction if necessary (can equally regulate the corrugated fiberboard 10 in the width direction W by the roller units 251 if necessary).

The pressing unit control unit 20D controls the operation of the hollow motor 254*e* to appropriately move each roller unit 251 in the width direction W, and each roller unit 251 moves to above the specific column set by the specific column setting unit 20C.

In addition, the pressing unit control unit 20D sets a regulation height, by which the corrugated fiberboard 10 is regulated, based on the sheet thickness information acquired from the production management device 50, and appropriately lifts and lowers each roller unit 251 such that the height of the lower end of the pressure roller becomes the regulation height.

The regulation height is set to be positioned higher by a predetermined distance L from an ideal printing surface height (this ideal printing surface height becomes the printing surface height in a case where floating of the corrugated fiberboard 10 does not occur and is a height positioned higher by the thickness of the corrugated fiberboard from the sheet transport passage Ls) of the corrugated fiberboard 10.

Preferably, the predetermined height L (in order words, is an allowable height even when the corrugated fiberboard 10 floats from the sheet transport passage Ls) is set such that the position of ink landed on the sheet printing surface is not largely deviated, for example, the predetermined height L is 0 mm to 1 mm (0 mm or more and 1 mm or less). In addition, if the predetermined height L is too short, since the pressing unit 25 and the corrugated fiberboard 10 come into frequent contact with each other and the corrugated fiberboard 10 is likely to be polluted or damaged, more preferably, the distance L is 0.5 mm to 1 mm (0.5 mm or more and 1 mm or less). Of course, the predetermined height L is not limited to the range.

In addition, in a case where the predetermined height L is 0 mm, the pressing unit 25 comes into normal contact with the corrugated fiberboard. However, the pressing unit 25 approximately lightly touches the corrugated fiberboard 10 (so-called kiss touch). Accordingly, compared to the sheet guide of PTL 1 described in the Background Art in which the sheet guide presses the corrugated fiberboard 10, it is possible to prevent the corrugated fiberboard 10 from being polluted or damaged.

[1-4. Effects]

Effects of the present embodiment will be described with reference to FIGS. 5A and 5B.

Figure 5A:
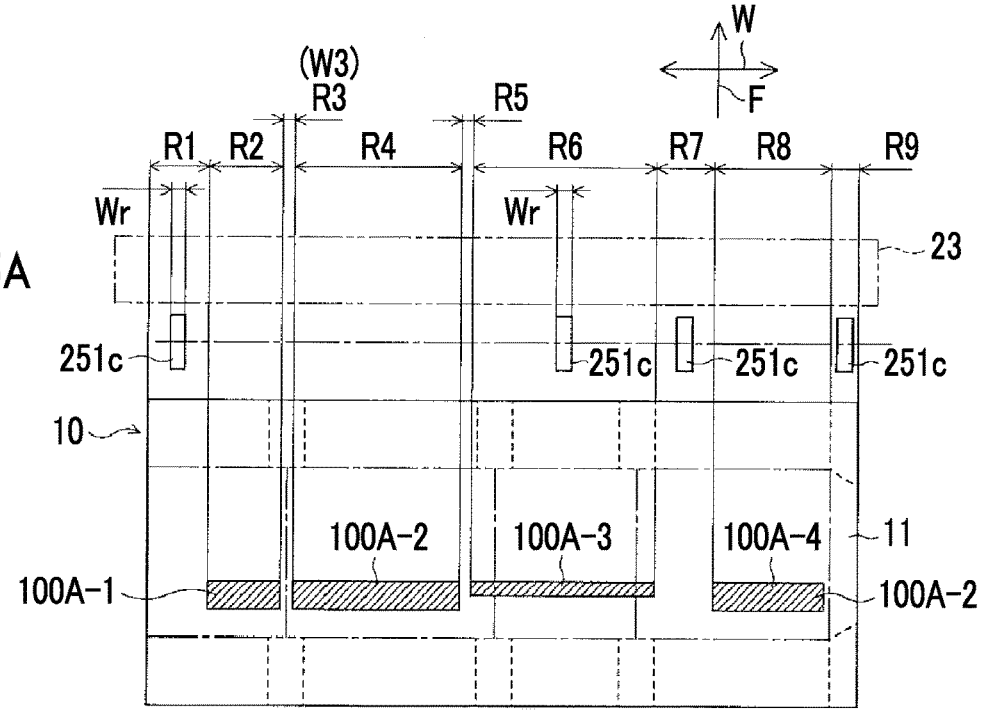
FIGS. 5A and 5B are views for explaining effects of the first embodiment of the present invention, and are schematic plan views showing a corrugated fiberboard and a pressing roller together.
Figure 5B:
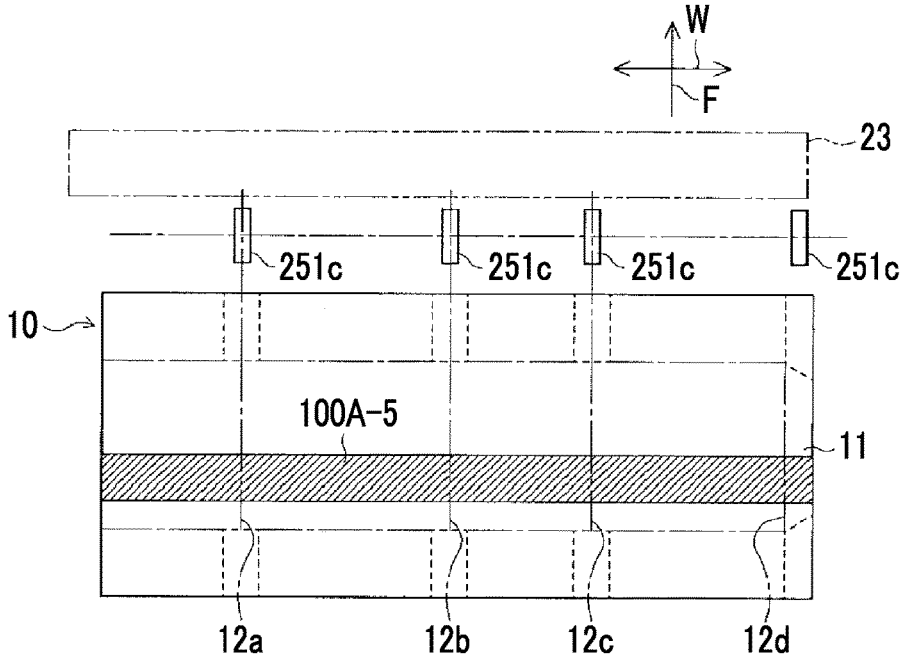

FIGS. 5A and 5B are schematic plan views for explaining effects of the present embodiment, and for convenience, the head 23 is indicated by two-dot chain lines, the pressing rollers 251*c* are indicated by solid lines, and other configurations of the inkjet printing unit 22 are omitted.

In FIGS. 5A and 5B, chain lines indicate creasing (including creasing which is post-processed by the paper discharge section 3 and the die-cut section 4 positioned on the downstream side of the pressing unit 25), and broken lines indicate groove portions which are formed from now in the paper discharge section 3 or the die-cut section 4. Reference numerals 100A-1 to 100A-4 indicate fixed printing by the flexographic printing units 21A to 21D.

First, if the example shown in FIG. 5A is described, the specific column setting unit 20C virtually classifies the corrugated fiberboard 10 into multiple columns R1 to R9 in the width direction W.

The column R1 is a column in which the fixed pattern by the flexographic printing does not exist (the ink coverage Ra_F related to the flexographic printing is 0 (zero)).

The column R2 is a column which includes the fixed pattern 100A-1 by the flexographic printing and in which the ink coverage Ra_F related to the flexographic printing exceeds the threshold value Ra_Th.

The column R3 is a column which is positioned between the fixed patterns 100A-1 and 100A-2 by the flexographic printing and in which the fixed pattern by the flexographic printing does not exist.

The column R4 is a column which includes the fixed pattern 100A-2 by the flexographic printing and in which the ink coverage Ra_F related to the flexographic printing exceeds the threshold value Ra_Th.

The column R5 is a column which is positioned between the fixed patterns 100A-2 and 100A-3 by the flexographic printing and in which the fixed pattern by the flexographic printing does not exist.

The column R6 is a column which includes the fixed pattern 100A-3 by the flexographic printing and in which the ink coverage Ra_F by the flexographic printing is equal to or less than the threshold value Ra_Th.

The column R7 is a column in which the fixed pattern by the flexographic printing does not exist.

The column R8 is a column which includes the fixed pattern 100A-4 by the flexographic printing and in which the ink coverage Ra_F related to the flexographic printing exceeds the threshold Ra_Th.

The column R9 is a column which includes the glue application location 11 of the corrugated fiberboard 10 and the fixed pattern by the flexographic printing does not exist.

In addition, the specific column setting unit 20C sets the specific columns having the same number as the number of the roller units 251 according to the above-described priority level. In the example shown in FIG. 5A, in a descending order of priority levels, the columns R1, R7, and R9 (the first priority level) in which the fixed pattern by the flexographic printing does not exist, and the column R6 (the fourth priority level) in which the ink coverage Ra_F by the flexographic printing is equal to or less than the threshold value Ra_Th although the fixed pattern by the flexographic printing exists are set to the specific columns.

In addition, although the column R3 is the column which is positioned between the fixed patterns 100A-1 and 100A-2 by the flexographic printing and in which the fixed pattern by the flexographic printing does not exist, the column R3 is excluded from the setting of the specific column based on the ink coverage Ra_F.

This is because a width dimension W3 of the column R3 is narrower than a width dimension Wr of the pressing roller 251*c*, and therefore, if the column R3 is set to the specific column and the pressing roller 251*c* is disposed above the column R3, the pressing roller 251*c* is disposed on not only the column R3 but also the both columns R2 and R4. That is, this is because the pressing roller 251*c* is likely to come into contact with the corrugated fiberboard 10 on the columns R2 and R4 in which the ink coverage Ra_F exceeds the threshold Ra_Th. Due to similar reasons, the column R5 is excluded from the setting of the specific column based on the ink coverage Ra_F.

In addition, the pressing unit control unit 20D appropriately moves the respective pressing rollers 251*c* (roller unit 251) in the width direction such that four pressing rollers 251*c* respectively move to above the specific columns R1, R6, R7, and R9.

In addition, like the column R6, a wide column in which multiple pressing rollers 251*c* can be disposed is set to multiple specific columns, and the multiple the pressing rollers 251*c* may be disposed on the multiple specific columns.

Moreover, since the a low image line column is positioned on only one side of the corrugated fiberboard 10, in a case where the specific column is set to be deviated toward one side of the corrugated fiberboard 10, it is difficult to prevent the corrugated fiberboard 10 from floating over the entire width. In this case, in order to equally suppress the corrugated fiberboard 10 over the entire width, the glue application location or the creasing location which typically has a lower priority level than that of the low image line column may be preferentially set to the specific column than the low image line column.

Next, the example shown in FIG. 5B will be described. In this example, a band-shaped fixed pattern 100A-5 is printed over the entire width by the flexographic printing, and the ink coverage Ra_F related to the flexographic printing exceeds the threshold value Ra_Th over the entire width of the corrugated fiberboard 10. Accordingly, according to the above-described priority level, in a descending order of priority levels, the specific column setting unit 20C temporarily selects the glue application location 11 (priority level 1), and the creasing locations 12*a*, 12*b*, 12*c*, and 12*d* (priority level 2) in which the creasing is formed. However, since the number of the specific columns is five and exceeds the number (four) of the roller units 251, the specific column setting unit 20C performs selection from among the creasing locations 12*a*, 12*b*, 12*c*, and 12*d* having a lower priority level such that the corrugated fiberboard 10 can be equally regulated if necessary in the width direction by the roller unit 251. Here, the creasing location 12*d* which is closest to the glue application location 11 which is firstly preferentially set to the specific column is excluded, and the glue application location 11, and the creasing locations 12*a*, 12*b*, and 12*c* are set to the specific columns.

Therefore, the following advantages are obtained according to the present embodiment. As the specific column in which a printing quality of the corrugated fiberboard 10 is less influenced, as a column has lower ink coverage Ra_F, the column is preferentially selected. Accordingly, as the specific column, that is, as the site at which the position of the corrugated fiberboard 10 is regulated by the roller unit 251, the site in which the pattern by the flexographic printing does not exist is firstly preferentially selected. Therefore, the roller unit 251 regulating the corrugated fiberboard 10 does not pollute the pattern which is not completely fixed to the printing surface of the corrugated fiberboard 10 immediately after the corrugated fiberboard 10 is printed by the flexographic printing section 21.

Accordingly, it is possible to prevent the corrugated fiberboard 10 from coming into contact with the inkjet head by the roller unit 251 before the contact occurs while favorably maintaining the printing quality of the corrugated fiberboard 10.

In addition, even in the case where the printing by the flexographic printing section 21 is positioned over the entire width of the corrugated fiberboard 10, as the specific column, the location in which the ink coverage Ra_F is low, that is, the location in which an ink attachment area ratio is low is selected. Accordingly, even when the floating corrugated fiberboard 10 comes into contact with the roller unit 251 in a case where the roller unit 251 is disposed so as to be separated from the printing surface of the corrugated fiberboard 10, a probability of the corrugated fiberboard 10 coming into contact with the roller unit 251 at the location in which the pattern exists can be decreased. In addition, even in a case where the roller unit 251 is disposed so as to comes into constant contact with the sheet printing surface (in a case where a distance L between the sheet printing surface and the pressing roller 251*c*) is set to 0 mm), the contact area between the roller unit 251 and the pattern is small. Accordingly, it is possible to decrease influences with respect to the printing quality.

In addition, in a case where the low ink coverage column in which the ink coverage Ra_F is lower than the threshold value Ra_Th does not exist and in a case where the distribution of the low ink coverage columns is deviated and the corrugated fiberboard 10 cannot be uniformly regulated, the creasing locations 12*a*, 12*b*, 12*c*, and 12*d* (hereinafter, referred to as a creasing location 12 in a case of being not specifically classified) or the glue application location 11 is set to the site at which the corrugated fiberboard 10 is regulated. The creasing location 12 is a site which becomes a corner portion when the corrugated fiberboard 10 is assembled to form a box shape, and the glue application location 11 is a site at which the corrugated fiberboard 10 is bonded when the corrugated fiberboard 10 becomes the box sheet material 10*a*.

Therefore, even when the creasing location 12 or the glue application location 11 is regulated by the roller unit 251 and the pattern is polluted, since the creasing location 12 or the glue application location 11 is a site which is not seen or cannot be seen, it is possible to maintain the printing quality of the corrugated fiberboard 10.

In addition, in general, since the creasing location or the glue application location 11 exist in the corrugated fiberboard 10, it is possible to reliably set the specific column even in the case where the low ink coverage column does not exist.

Moreover, the following advantages are obtained by the present embodiment.

The roller unit 251 (pressing roller 251*c*) is controlled so as to be positioned on the corrugated fiberboard 10. That is, the distance L between the printing surface of the corrugated fiberboard 10 and the pressing roller 251*c* is set to at least 0 mm. Accordingly, the roller unit 251 is separated from the corrugated fiberboard 10 or is kiss-touched to the corrugated fiberboard 10, and the roller unit 251 does not come into press-contact with corrugated fiberboard 10. Accordingly, compared to a case where the roller unit 251 positively presses the corrugated fiberboard 10, it is possible to reduce a burden imposed on the corrugated fiberboard 10, and it is possible to prevent the corrugated fiberboard 10 from being damaged.

Particularly, in a case where the pressing roller 251*c* is disposed so as to be separated from the printing surface of the corrugated fiberboard 10, only when the floating of the corrugated fiberboard 10 increases and the corrugated fiberboard 10 approaches the inkjet head 23 within a predetermined distance, the corrugated fiberboard comes into contact with the pressing roller 251*c*. Accordingly, since the corrugated fiberboard 10 and the pressing roller 251*c* do not come into contact with each other at all times, it is possible to prevent the corrugated fiberboard 10 from being polluted or damaged due to the contact between the corrugated fiberboard 10 and the pressing roller 251*c*.

Moreover, since the roller unit 251 is lifted and lowered according to the thickness of the corrugated fiberboard 10, it is possible to set the height of the roller unit 251 to an optimal height regardless of the thickness of the corrugated fiberboard 10, it is possible to decrease an unnecessary contact between the roller unit 251 and the corrugated fiberboard 10, and it is possible to reliably prevent the corrugated fiberboard 10 from being damaged.

[2. Second Embodiment]

[2-1. Configuration]

With respect to the first embodiment, as shown by a two-dot chain line, a corrugated fiberboard printing device of the present embodiment further includes an inkjet printing unit 22A in addition to the flexographic printing section 21 as another printing unit which performs printing on the upstream side of the pressing unit 25. The inkjet printing unit 22A is disposed on immediately the upstream side (that is, between the inkjet printing unit 22 and the flexographic printing section 21) of the inkjet printing unit 22.

The inkjet printing unit 22A performs printing using different colors from those of the inkjet printing unit 22, and the configuration of inkjet printing unit 22A is similar to that of the inkjet printing unit 22. In FIG. 1, for convenience, the inkjet printing unit 22A is shown so as to be smaller than the inkjet printing unit 22. In addition, the inkjet printing unit 22A may be provided on the upstream side of the flexographic printing section 21.

In the present embodiment, the specific column setting unit 20C (refer to FIG. 4) which configures the function of the controller 20 firstly preferentially sets the low ink coverage column in which a total ink coverage Ra_T is the predetermined threshold value Ra_Th or less to the specific column (priority level 1), similarly to the first embodiment, secondarily preferentially sets the glue application location to the specific column (priority level 2), and thirdly preferentially sets the creasing location to the specific column (priority level 3).

Here, the total ink coverage Ra_T is the sum of the ink coverage Ra_F of the flexographic printing section 21 and the ink coverage Ra_I of the inkjet printing unit 22A (total ink coverage Ra_T=ink coverage Ra_F of flexographic printing section 21+ink coverage Ra_I of inkjet printing unit 22A).

In addition, a low ink coverage column in which the total ink coverage Ra_T is the predetermined threshold value Ra_Th or less includes a column in which the total ink coverage Ra_T is 0%, that is, a column in which the pattern by the printing of the flexographic printing section 21 and the pattern by the printing of the inkjet printing unit 22A do not exist.

Since other configurations are similar to those of the first embodiment, descriptions thereof are omitted.

[2-2. Effects]

Figure 6A:
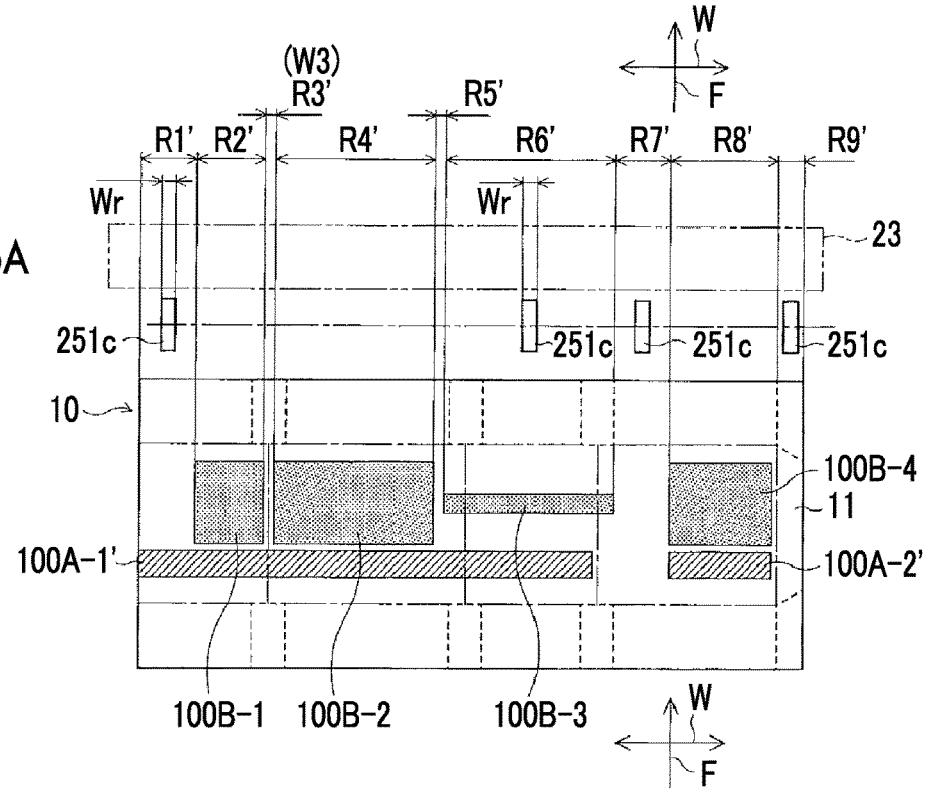
FIGS. 6A and 6B are views for explaining effects of a second embodiment of the present invention, and are schematic plan views showing a corrugated fiberboard and a pressing roller together.
Figure 6B:
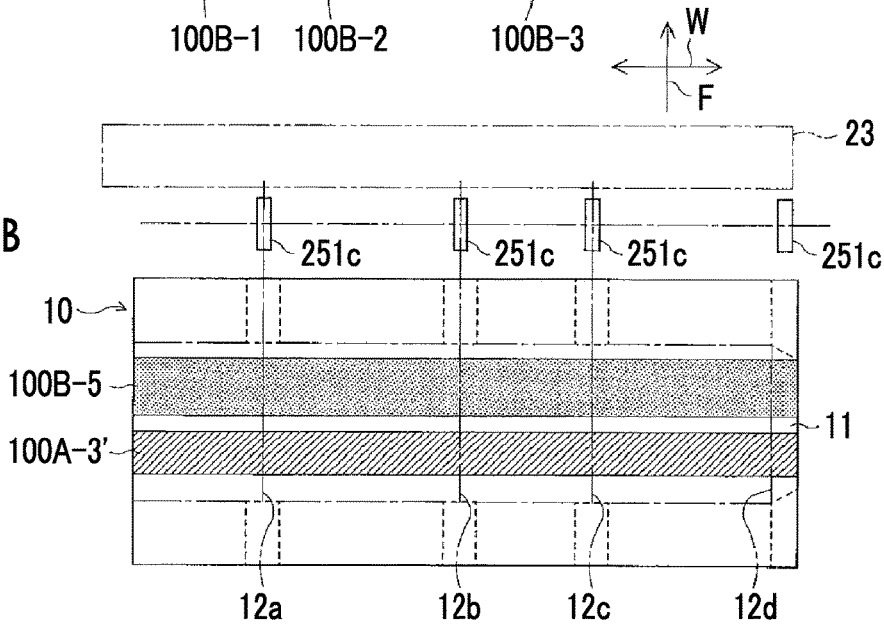

FIGS. 6A and 6B are schematic plan views for explaining effects of the present embodiment, and for convenience, the head 23 is indicated by two-dot chain lines, the pressing rollers 251*c* are indicated by solid lines, and other configurations of the inkjet printing unit 22 are omitted.

In FIGS. 6A and 6B, chain lines indicate creasing (including creasing which is post-processed by the paper discharge section 3 and the die-cut section 4 positioned on the downstream side of the pressing unit 25), and broken lines indicate groove portions which are formed from now in the paper discharge section 3 or the die-cut section 4. Reference numerals 100A-1' to 100A-3' indicate fixed printing by the flexographic printing units 21A to 21D. Reference numerals 100B-1 to 100B-5 indicate variable printing by another inkjet printing unit 22A.

First, if the example shown in FIG. 6A is described, the specific column setting unit 20C virtually classifies the corrugated fiberboard 10 into multiple columns R1' to R9' in the width direction W.

The column R1' is a column in which the variable pattern by the printing of the inkjet printing section 22A does not exist (the ink coverage Ra_I related to the inkjet printing 22A is 0 (zero)), which includes the fixed pattern 100A-1' by the flexographic printing, and in which the total ink coverage Ra_T is the threshold Ra_Th or less.

The column R2' is a column which includes the variable pattern 100B-1 by the printing of the inkjet printing section 22A and the fixed pattern 100A-1' by the flexographic printing and in which the total ink coverage Ra_T exceeds the threshold Ra_Th.

The column R3' is a column which includes only the fixed pattern 100A-1' by the flexographic printing and in which the total ink coverage Ra_T is the threshold value Ra_Th or less.

The column R4' is a column which includes the variable pattern 100B-2 by the printing of the inkjet printing section 22A and the fixed pattern 100A-1' by the flexographic printing and in which the total ink coverage Ra_T exceeds the threshold value Ra_Th.

The column R5' is a column which includes only the fixed pattern 100A-1' by the flexographic printing and in which the total ink coverage Ra_T is the threshold value Ra_Th or less.

The column R6' is a column which includes the variable pattern 100B-3 by the printing of the inkjet printing section 22A and the fixed pattern 100A-1' by the flexographic printing and in which the total ink coverage Ra_T is the threshold value Ra_Th or less.

The column R7' is a column in which the variable pattern by the printing of the inkjet printing section 22A and the fixed pattern by the flexographic printing do not exist and the total ink coverage Ra_T is 0 (zero).

The column R8' is a column which includes the variable pattern 100B-4 by the printing of the inkjet printing section 22A and the fixed pattern 100A-2' by the flexographic printing and in which the total ink coverage Ra_T exceeds the threshold value Ra_Th.

The column R9' is a column which includes the glue application location 11 of the corrugated fiberboard 10 and in which the variable pattern by the printing of the inkjet printing section 22A and the fixed pattern by the flexographic printing do not exit.

In addition, the specific column setting unit 20C sets the specific columns having the same number as the number of the roller units 251 according to the above-described priority level. In the example shown in FIG. 6A, in a descending order of priority levels, the columns R7' and R9' (the first priority level) in which the total ink coverage Ra_T is 0 (zero) and the columns R1' and R6' (the fourth priority level) in which the total ink coverage Ra_T is the threshold value Ra_Th or less are set to the specific columns.

Moreover, although the column R3' is the column in which the total ink coverage Ra_T is the threshold value Ra_Th or less, since the width dimension W3 of the column R3' is narrower than the width dimension Wr of the pressing roller 251*c*, the column R3' is excluded from the setting of the specific column based on the ink coverage.

Next, the example shown in FIG. 6B is described. In this example, in the corrugated fiberboard 10, a band-shaped variable pattern 100B-5 is printed over the entire width by the printing of the inkjet printing section 22A and a band-shaped fixed pattern 100A-3' is printed over the entire width by the flexographic printing, and the total ink coverage Ra_T exceeds the threshold value Ra_Th over the entire width of the corrugated fiberboard 10. Accordingly, according to the above-described priority level, in a descending order of priority levels, the specific column setting unit 20C temporarily selects the glue application location 11 (priority level 1), and the creasing locations 12*a*, 12*b*, 12*c*, and 12*d* (priority level 2) in which the creasing is formed. However, since the number of the specific columns is five and exceeds the number (four) of the roller units (pressing roller 251) 251, similarly to the first embodiment, the specific column setting unit 20C excludes the creasing location 12*d* closest to the glue application location 11 which is firstly preferentially set to the specific column and sets the glue application location 11 and the creasing locations 12*a*, 12*b*, and 12*c* to the specific columns such that the corrugated fiberboard 10 can be equally regulated if necessary in the width direction by the roller unit 251.

Therefore, according to the present embodiment, similarly to the first embodiment, since the column in which the total ink coverage Ra_T is lower is preferentially selected as the specific column, effects similar to those of the first embodiment can be obtained.

[2-3. Others]

When the total ink coverage Ra_T is obtained using the ink coverage of the flexographic printing section 21 and the ink coverage of the inkjet printing unit 22A, correction may be performed by a degree of dryness of ink used in the printing. As the method of the correction, as expressed in the following Expression (1), a method is exemplified which uses ink coverage Ra_F1, Ra_F2, Ra_F3, and Ra_F4 of the flexographic printing units 21A, 21B, 21C, and 21D, the ink coverage Ra_I of the inkjet printing unit 22A, and weighting correction coefficients k1 to k5 which are set by the degree of dryness of ink.

In the flexographic printing section 21, since the degrees of dryness are different from each other every the flexographic printing units 21A to 21D, the ink coverage Ra_F1, Ra_F2, Ra_F3, and Ra_F4 of the flexographic printing units 21A, 21B, 21C, and 21D are amended using correction coefficients k1 to k4 which are set according to the degrees of dryness.

$$\text{Total ink coverage } Ra_T = k1 \times Ra_F1 + k2 \times Ra_F2 + k3 \times Ra_F3 + k4 \times Ra_F4 + k5 \times Ra_I \quad (1)$$

Specifically, the weighting correction coefficients k1 to K5 are set to be smaller as the degree of dryness of ink at the time when the corrugated fiberboard 10 on which the patterns are printed by the flexographic printing units 21A to 21D and the inkjet printing unit 22A reaches the pressing unit 25 increases (as dryness proceeds and a degree of fixation increases).

The degree of dryness of ink increases as permeability (drying properties) of the ink increases, and increases as the film thickness of ink on the corrugated fiberboard 10 decreases. In the flexographic ink used in the flexographic printing section 21, the permeability is high and drying (fixation) is fast, and in the inkjet ink used in the inkjet printing unit 22A, the drying also is fast. In addition, the degree of dryness of ink increases as an elapse time after the ink on the corrugated fiberboard 10 is longer (in other words, as a parameter which is in a proportional relationship with the elapse time such as the transport distance of the corrugated fiberboard 10 after the ink is attached to the corrugated fiberboard 10 is larger (longer)).

Accordingly, the weighting correction coefficients k1 to K5 are set to be smaller as the permeability (dry properties) of the ink increases, and are set to be smaller as the elapse time after the ink on the corrugated fiberboard 10 is longer (or, as the parameter which is in a proportional relationship with the elapse time such as the transport distance of the corrugated fiberboard 10 after the ink is attached to the corrugated fiberboard 10 is larger (longer))

Moreover, the weighting coefficient is changed according to the kind of the corrugated fiberboard or presence or absence of a drying device in addition of the kind of ink or the elapse time.

As described above, the flexographic ink has higher drying properties than those of the inkjet ink. In addition, in the second embodiment, since the flexographic printing section 21 is positioned on the upstream side of the inkjet printing unit 22A, the elapse time after the flexographic ink is attached to the corrugated fiberboard 10 at the time when the corrugated fiberboard 10 reaches the pressing unit 25 is longer than the elapse time after the inkjet ink is attached to the corrugated fiberboard 10. Therefore, in the second embodiment, in the case where the weighting correction coefficients k1 to k5 are used, the weighting correction coefficients k1 to k4 which are multiplied to the ink coverage Ra_F1 to Ra_F4 of the flexographic printing section 21 is set to be smaller than the weighting correction coefficient k5 which is multiplied to the ink coverage Ra_I of the inkjet printing unit 22A.

Accordingly, the total ink coverage Ra_T of the column is corrected to be smaller, and the column is easily set to the specific column, that is, the location at which the position of the corrugate fiberboard 10 is regulated as the degree of dryness of the ink increases in the column, that is, the printing quality is less decreased in the column even when the column is pressed by the pressing unit 25. Therefore, it is possible to more effectively present the printing quality of the corrugated fiberboard 10 from decreasing.

Moreover, if the flexographic ink is sufficiently dried even when the corrugated fiberboard 10 comes into contact with the pressing roller 251*c* at the time of reaching the pressing unit 25 and the corrugated fiberboard 10 is not likely to be polluted by the flexographic printing, the weighting correction coefficients k1 to k4 are set to 0 (zero).

[3. Others]

(1) In the above-described embodiments, the information acquisition unit 20A of the controller 20 acquires the sheet thickness information (the thickness information of the corrugated fiberboard 10) from the production management device 50 and adjusts the heights of the head 23 and the roller unit 251 to be appropriate heights which are higher by the predetermined height L than the printing surface of the corrugated fiberboard 10, based on the sheet thickness information. However, the present invention is not limited to this. For example, a displacement sensor is provided above the sheet transport passage Ls, the printing surface height of the corrugated fiberboard 10 which has the height of the sheet transport passage Ls as a reference height is detected by the displacement sensor, and the information acquisition unit 20A may acquire the detection result as the sheet thickness. According to this configuration, it is possible to adjust the head 23 and the roller unit 251 to be more appropriate heights based on the actual thickness of the corrugated fiberboard 10.

(2) In the above-described embodiments, as the setting of the specific column, the setting based on the ink coverage is firstly preferentially performed, and the glue application location 11 or the creasing location 12 is secondarily preferentially set to the specific column. However, the setting method of the specific column is not limited to this.

For example, the ink coverage is not used for the setting of the specific column, and at least one of the creasing location 12 and the glue application location 11 may be set to the specific column. In general, since the creasing location 12 and the glue application location 11 exist in the corrugated fiberboard, the creasing location 12 or the glue application location 11 can be constantly set to the specific column, that is, the site at which the position of the corrugated fiberboard is regulated. Accordingly, the control for setting sites except for the creasing location 12 and the glue application location 11 to the specific column is not required, and the control can be simplified.

(3) In the above-described embodiments, the pressing unit 25 is disposed on the upstream side of the inkjet head 23 of the inkjet printing unit 22. However, the pressing unit (protection device) may be disposed on the downstream side of the inkjet head 23 instead of the upstream side of the inkjet head 23 or along with the upstream side of the inkjet head 23.

In the embodiment, since the pressing unit 25 is provided on the upstream side of the inkjet head 23, in order to prevent ink which is not completely fixed so as to attached to the sheet printing surface on the upstream side from being rubbed on the sheet printing surface and polluting the sheet printing surface, as a column has lower ink coverage of the upstream flexographic printing or a lower total ink coverage of the upstream flexographic printing and the inkjet printing, the specific column setting unit 20C preferentially sets the column as the specific column.

Meanwhile, in the pressing unit which is provided on the downstream side of the inkjet head 23, the specific column setting unit 20C gives weight to the ink coverage related to the printing by the inkjet head 23 immediately before being pressured by the pressing unit 25. That is, when the total ink coverage Ra_T of the pattern which is printed on the upstream side of the pressing unit 25 is calculated, a large weighting coefficient is applied to the ink coverage Ra_I by the inkjet head 23 immediately before being pressure by the pressing unit 25.

Meanwhile, since a location having the pattern by the printing of the inkjet head 23 immediately before being pressure by the pressing unit 25 is difficult to be set to the specific column, it is possible to prevent the pattern which is inkjet-printed by the contact with the pressing unit 25 from being polluted.

In a modification example of the second embodiment described with reference to FIGS. 6A and 6B, the ink coverage of the inkjet printing unit 22A is used in the ink coverage Ra_I of Expression (1), and with respect to the inkjet printing unit 22A, the weighting correction coefficient k5 is set. Meanwhile, as described above, in the case where the pressing unit 25 is disposed on the downstream side of the inkjet head 23 of the inkjet printing unit 22 and only the flexographic printing units 21A to 21D are installed on the upstream side of the inkjet head 23 of the inkjet printing unit 22 as the printing unit (that is, in a case where the inkjet head 23 of the inkjet printing unit 22 itself and the flexographic printing units 21A to 21D are disposed on the upstream side of the pressing unit), the ink coverage of the inkjet head 23 of the inkjet printing unit 22 is used in the ink coverage Ra_I of Expression (1), and with respect to the inkjet head 23 of the inkjet unit 22, the weighting correction coefficient k5 is set. The setting method of the correction coefficient k5 and the setting method the correction coefficients k1 to k4 set with respect to the flexographic printing units 21A to 21D are performed as described above.

(4) In the above-described embodiments, the diameter Dr of the pressing roller 251*c* is set so as to be smaller than the diameter Dc of the plate cylinder 21*a* of each of the flexographic printing units 21A to 21D. However, in a case where the distance L between the pressing roller 251*c* and the corrugated fiberboard 10 is 0 mm and the pressing roller 251*c* comes into contact with the transported corrugated fiberboard 10 and is rotated according to the movement of the corrugated fiberboard 10, the diameter Dr of the pressing roller 251*c* may be the same as the diameter Dc of the plate cylinder 21*a* (Dr=Dc). Accordingly, even when the ink of the flexographic printing is inversely transferred from the corrugated fiberboard 10 to the peripheral surface of the pressing roller 251*c* and the inversely transferred ink is re-transferred from the pressing roller 251*c* to the corrugated fiberboard 10, it is possible to prevent the printing quality of the corrugated fiberboard 10 from decreasing.

That is, since the pressing roller 251*c* rotates at the same peripheral speed as the transport speed of the corrugated fiberboard 10 according to the movement of the corrugated fiberboard 10 and the plate cylinder 21*a* rotates at the same peripheral speed as the transport speed of the corrugated fiberboard 10 during the printing, in the case where the pressing roller 251*c* has the same diameter as that of the plate cylinder 21*a*, the position at which the pattern is re-transferred from the pressing roller 251*c* to the corrugated fiberboard 10 corresponds to the position at which the pattern is transferred to the corrugated fiberboard 10 by the plate cylinder 21*a*. That is, a pattern similar to a regular pattern is re-transferred from the pressing roller 251*c* without a positional deviation to the regular pattern which is transferred to the corrugated fiberboard 10 by the plate cylinder 21*a*. Accordingly, the ink which is re-transferred from the pressing roller 25 to the corrugated fiberboard 10 is not polluted.

(5) In the above-described embodiments, the regulation means for regulating approaching of the corrugated fiberboard 10 within the predetermined distance against the inkjet head 23 is configured of the means (pressing roller unit) for coming into contact with the corrugated fiberboard 10 to perform the regulation. However, the regulation means is not limited to this. For example, as the regulation means, an air guide (injection device) which injects gas such as air to the corrugated fiberboard 10 from above to regulate the floating of the corrugated fiberboard 10 may be used.

In the case where the air guide is used as the regulation means, preferably, the specific column setting unit 20C sets the specific column based on the ink coverage related to the inkjet printing regardless of the regulation means being disposed on the upstream side or the downstream side of the inkjet head 23. This is because the flow of the air injected from the air guide is likely to disturb the flow of the ink injected from inkjet head 23 while the flow of the air injected from the air guide does not influence the flexographic printing.

That is, the specific column in which the floating of the corrugated fiberboard 10 is regulated by the injection from the air guide is set to the low ink coverage column in which the ink coverage related to the inkjet printing is low (including the case where the pattern does not exist), and as a column has lower ink coverage related to the inkjet printing, the column is preferentially set to the specific column. Accordingly, it is possible to perform the regulation of the corrugated fiberboard by the injection of the air guide while decreasing influences on the inkjet printing.

(6) In the above-described embodiments, the number of the pressing roller units 251 serving as the regulation means is four. However, the number of the regulation means is not limited to this. If the number of regulation means increases, since it is possible to effectively prevent the floating of the corrugated fiberboard, the increase in the number of the regulation means is preferable.

If the number of the regulation mean increase, the number of the specific columns set by the specific column setting unit is smaller than the number of the regulation means, an unused regulation mean may occur. In this case, the unused regulation means may move to a standby position at which the regulation means is not used to regulate the corrugated fiberboard 10. For example, the standby position is a high position at which the floating corrugated fiberboard does not come into contact with the regulation means or a position deviated from the sheet transport passage S in the width direction W.

(7) In the above-described first embodiment, the number of the inkjet printing units is one, and in the above-described second embodiment, the number of the inkjet printing units is two. However, the number of the inkjet printing units may be any number.

(8) In the above-described embodiments, the example in which the flexographic printing units 21A to 21D are disposed on the upstream of the inkjet printing unit 22 is described. However, the flexographic printing units 21A to 21D may not be provided, and only the inkjet printing may be performed on the corrugated fiberboard 10 by one or more inkjet printing units.

(9) In the above-described embodiments, the aspect is described in which the flexographic printing units 21A to 21D or the inkjet printing unit 22A is used as the other printing units which are disposed on the upstream side of the inkjet printing unit 22. However, the other printing units which are disposed on the upstream side of the inkjet printing unit 22 are not limited to the flexographic printing unit or the inkjet printing unit and may be printing units of other types.

REFERENCE SIGNS LIST

2: printing section
10: corrugated fiberboard
11: glue application location of corrugated fiberboard 10
12*a*, 12*b*, 12*c*, 12*d*: creasing location
20: controller
20A: information acquisition unit (sheet thickness acquisition means)
20B: inkjet head control unit
20C: specific column setting unit
20D: pressing unit control unit (movement mechanism control unit)
21: flexographic printing section
21A to 21D: flexographic printing unit (other printing units)
21*a*: plate cylinder (print cylinder) of flexographic printing unit
22: inkjet printing unit
22A: inkjet printing unit (other printing units)
23: inkjet head
24: movement unit
25: pressing unit (protection device)
50: production management device
100A-1 to 100A-5, 100A-1' to 100A-3': fixed pattern
100B-1~100B-5: variable pattern
251: pressing roller unit (regulation means, regulation part)
251*c*: pressing roller
Dc: diameter of plate cylinder (print cylinder) 21*a*
Dr: diameter of pressing roller 251*c*
k1 to k5: weighting correction coefficient
Ls: transport passage
R1~R9, R1'~R9': column
Ra_F1~F4: ink coverage by flexographic printing
Ra_I: ink coverage by inkjet printing
Ra_T: total ink coverage
Ra_Th: threshold of ink coverage

The invention claimed is:

1. A corrugated fiberboard printing device which prints a pattern to a corrugated fiberboard which is transported on a transport passage, comprising:

an inkjet head which is disposed above the transport passage and injects ink to the corrugated fiberboard;

a protection device which regulates approaching of the corrugated fiberboard within a predetermined distance against the inkjet head; and a controller which acquires order information of the corrugated fiberboard from a production management device and controls the operations of the inkjet head and the protection device, wherein the protection device includes multiple regulation means which are juxtaposed in a width direction of the corrugated fiberboard, and a movement mechanism which moves each of the multiple regulation means in the width direction, wherein the controller includes a specific column setting unit configured to set a specific column, in which a printing quality is less influenced by the regulation means, with respect to the corrugated fiberboard in a sheet width direction based on the order information, and a movement mechanism control unit which controls the operation of the movement mechanism and moves each of the regulation means so as to regulate the corrugated fiberboard in the specific column.

2. The corrugated fiberboard printing device according to claim 1, wherein the specific column setting unit sets a low ink coverage column, in which ink coverage is a threshold value or less, to the specific column.

3. The corrugated fiberboard printing device according to claim 2, wherein the specific column setting unit sets a creasing location at which creasing is formed or a glue application location at which glue is applied to the specific column in a case where the low ink coverage column does not exist or a distribution of the low ink coverage columns is biased.

4. The corrugated fiberboard printing device according to claim 1, wherein as a column has a lower ink coverage, the specific column setting unit preferentially sets the column to the specific column.

5. The corrugated fiberboard printing device according to claim 4, wherein the specific column setting unit sets a creasing location at which creasing is formed or a glue application location at which glue is applied to the specific column in a case where the lower ink coverage column does not exist or a distribution of the lower ink coverage columns is biased.

6. The corrugated fiberboard printing device according to claim 4, wherein the inkjet head is provided to face a transport surface of the corrugated fiberboard in a box-making machine, wherein each of the regulation means is configured of an injection device which injects air to the corrugated fiberboard from above, and wherein the specific column setting unit sets the specific column using ink coverage of printing by the inkjet head as the ink coverage.

7. A box-making machine of a corrugated fiberboard, comprising:

the corrugated fiberboard printing device according to claim 4 which is provided on he downstream side of the printing unit in a transport direction of the corrugated fiberboard.

8. The corrugated fiberboard printing device according to claim 1, wherein the specific column setting unit sets a creasing location at which creasing is formed to the specific column.

9. The corrugated fiberboard printing device according to claim 1, wherein the specific column setting unit sets a glue application location at which glue is applied to the specific column.

10. The corrugated fiberboard printing device according to claim 1, wherein each of the regulation means is a regulation part which is disposed above the transport passage by at least the thickness of the corrugated fiberboard and comes into contact with the corrugated fiberboard to regulate an upward displacement of the corrugated fiberboard.

11. The corrugated fiberboard printing device according to claim 10, wherein the regulation part is disposed so as to be separated from the upper surface of the corrugated fiberboard.

12. The corrugated fiberboard printing device according to claim 10, wherein the movement mechanism further includes a mechanism which moves the regulation part forward and rearward against the transport passage, wherein the controller includes a sheet thickness acquisition unit which acquires thickness information of the corrugated fiberboard, and wherein the movement mechanism control unit lifts and lowers the regulation part based on the thickness information which is acquired by the sheet thickness acquisition unit.

13. The corrugated fiberboard printing device according to claim 10, wherein the specific column setting unit sets a low ink coverage column, in which ink coverage is a threshold value or less, to the specific column using a total ink coverage of printing on the upstream side of the regulation part in a transport direction of the corrugated fiberboard as the ink coverage.

14. The corrugated fiberboard printing device according to claim 10, wherein the specific column setting unit preferentially sets a column having a lower ink coverage to the specific column using a total ink coverage of printing on the upstream side of the regulation part in a transport direction of the corrugated fiberboard as the ink coverage.

15. The corrugated fiberboard printing device according to claim 13, wherein the regulation part is provided on the upstream side of the inkjet head in the transport direction and the corrugated fiberboard is printed by one or more other printing units on the upstream side of the regulation part in the transport direction, wherein the specific column setting unit obtains the total ink coverage by summing ink coverage of printing by the one or more other printing units, and wherein when the specific column setting unit obtains the total ink coverage, the specific column setting unit corrects each ink coverage of the printing by the one or more other printing units according to a degree of dryness of ink on the corrugated fiberboard by the printing of the one or more other printing units.

16. The corrugated fiberboard printing device according to claim 10, wherein the corrugated fiberboard is printed by one or more other printing units on the upstream side of the regulation part in the transport direction, wherein the one or more other printing units have a print cylinder which rotates at the same peripheral speed as a transport speed of the corrugated fiberboard, and wherein the regulation part is a roller which is rotated to be driven by the movement of the transported corrugated fiberboard and has the same diameter as the diameter of the print cylinder.

17. The corrugated fiberboard printing device according to claim 13, wherein the regulation part is provided on the downstream side of the inkjet head in the transport direction, and the corrugated fiberboard is printed by one or more other printing units on the upstream side of the regulation part in the transport direction, wherein the specific column setting unit obtains the total ink coverage by summing ink coverage of printing by the one or more other printing units and ink coverage of printing by the inkjet head, and wherein when the specific column setting unit obtains the total ink coverage, the specific column setting unit corrects each ink coverage of the printing by the one or more other printing units according to a degree of dryness of each ink on the corrugated fiberboard by the printing of the one or more other printing units, and corrects the ink coverage of the printing by the inkjet head according to a degree of dryness of ink on the corrugated fiberboard by the printing of the inkjet head.

18. The corrugated fiberboard printing device according to claim 1, wherein the inkjet head is provided to face a transport surface of the corrugated fiberboard in a box-making machine, wherein each of the regulation means is configured of an injection device which injects air to the corrugated fiberboard from above, and wherein the specific column setting unit sets the specific column using ink coverage of printing by the inkjet head as the ink coverage.

19. A box-making machine of a corrugated fiberboard, comprising:

the corrugated fiberboard printing device according to claim 1 which is provided on the downstream side of the printing unit in a transport direction of the corrugated fiberboard.

* * * * *